US010818237B2

(12) United States Patent
Noh et al.

(10) Patent No.: US 10,818,237 B2
(45) Date of Patent: Oct. 27, 2020

(54) ORGANIC LIGHT-EMITTING DIODE DISPLAY DEVICE FOR IMPROVING IMAGE QUALITY BY TURNING OFF AN OLED

(71) Applicant: LG Display Co., Ltd., Seoul (KR)

(72) Inventors: Dong-In Noh, Gumi-si (KR); Young-Ho Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/224,243

(22) Filed: Dec. 18, 2018

(65) Prior Publication Data

US 2019/0197959 A1 Jun. 27, 2019

(30) Foreign Application Priority Data

Dec. 26, 2017 (KR) ..... 10-2017-0179086

(51) Int. Cl.

| | |
|---|---|
| ***G09G 3/3258*** | (2016.01) |
| ***G09G 3/3233*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3233* (2013.01); *G09G 3/3266* (2013.01); *G09G 3/3275* (2013.01); *G09G 2300/0819* (2013.01); *G09G 2300/0842* (2013.01); *G09G 2310/0251* (2013.01); *G09G 2310/08* (2013.01); *G09G 2320/0261* (2013.01); *G09G 2320/0295* (2013.01); *G09G 2320/043* (2013.01)

(58) Field of Classification Search

CPC ..... G09G 2310/08; G09G 3/3258; G09G 3/3266; G09G 2330/12; G09G 3/325; G09G 3/3241

See application file for complete search history.

(56) References Cited

U.S. PATENT DOCUMENTS

| | | | | |
|---|---|---|---|---|
| 2014/0022289 | A1* | 1/2014 | Lee | G09G 3/3283 345/691 |
| 2015/0161940 | A1* | 6/2015 | Woo | G09G 3/325 345/58 |
| 2015/0187267 | A1* | 7/2015 | Park | G09G 3/3233 345/77 |

* cited by examiner

*Primary Examiner* — Xuemei Zheng
(74) *Attorney, Agent, or Firm* — Birch, Stewart, Kolasch & Birch, LLP

(57) ABSTRACT

An OLED display device capable of improving picture quality by turning off an OLED element regardless of a charging time and input data of each subpixel is discussed. A reference voltage supplied to a reference line is supplied to an OLED element during at least one OLED off time after a light-emitting time and before a charging time according to control of a scan gate line and a sense gate line to turn off the OLED element. The reference voltage is lower than a threshold voltage of the OLED element.

18 Claims, 5 Drawing Sheets

ORGANIC LIGHT-EMITTING DIODE DISPLAY DEVICE FOR IMPROVING IMAGE QUALITY BY TURNING OFF AN OLED

CROSS-REFERENCE TO RELATED APPLICATION

This application claims the priority benefit of Korean Patent Application No. 10-2017-0179086, filed on Dec. 26, 2017 in the Republic of Korea, which is hereby incorporated by reference as if fully set forth herein.

BACKGROUND

Technical Field

The present disclosure relates to an organic light-emitting diode display device capable of improving picture quality by turning off an organic light-emitting diode element regardless of a charging time and input data of each subpixel.

Description of the Related Art

A general display device for displaying images includes a liquid crystal display (LCD) using liquid crystal, an organic light-emitting diode (OLED) display device using OLEDs, and an electrophoretic display (EPD) using electrophoretic particles.

Among these display devices, the OLED display device is a self-luminescent device which causes an organic light-emitting layer to emit light through recombination of electrons and holes and has advantages of high luminance, wide viewing angle, high contrast ratio, and ultra-thin film thickness.

Each subpixel constituting the OLED display device includes an OLED element and a pixel circuit for independently driving the OLED element. The pixel circuit adjusts the brightness of the OLED element in such a manner that a driving thin film transistor (TFT) adjusts current Ids for driving the OLED element according to a driving voltage Vgs corresponding to pixel data.

The OLED display device can use a black data insertion (BDI) scheme in which a black frame for turning off the OLED element is added to each frame by charging black data in each subpixel during every frame in order to improve a motion picture response time (MPRT).

However, the BDI scheme of the related art OLED display devices should drive each frame time-divided into a black frame and an image frame. In the black frame, all subpixels line-sequentially charge black data so that OLED elements are turned off. In the image frame, all subpixels line-sequentially charge pixel data so that OLED elements emit light.

Thus, since the BDI scheme of the related art OLED display devices should output black data and image data during one frame through time division, a memory for additionally storing input image data is needed and, therefore, manufacturing costs increase. Moreover, in time-dividing each frame into a black data supply period and an image data supply period, if a charging time of each subpixel is insufficient, a charging voltage can be distorted, thereby generating a charging voltage different from data and resulting in picture quality deterioration.

BRIEF SUMMARY

Accordingly, the present disclosure is directed to an OLED display device that substantially obviates one or more problems due to limitations and disadvantages of the related art.

In various embodiments, the present disclosure provides an OLED display device capable of improving picture quality by turning off OLED elements regardless of a charging time and input data of each subpixel.

Additional advantages, objects, and features of the disclosure will be set forth in part in the description which follows and in part will become apparent to those having ordinary skill in the art upon examination of the following description or may be learned from practice of the disclosure. The objectives and other advantages of the disclosure may be realized and attained by the structure particularly pointed out in the written description and claims hereof as well as the appended drawings.

To achieve these objects and other advantages and in accordance with the disclosure, as embodied and broadly described herein, an OLED display device includes a panel including a plurality of subpixels, each subpixel being connected to a corresponding one of scan gate lines, a corresponding one of sense gate lines, a corresponding one of data lines, a corresponding one of reference lines, and a corresponding one of power lines, a scan gate driver configured to drive the scan gate lines, a sense gate driver configured to drive the sense gate lines, and a data driver configured to drive the data lines and the reference lines, wherein the subpixel performs a charging operation during a charging time of the subpixel according to control of the scan gate line and the sense gate line, an OLED element of the subpixel emits light during a light-emitting time of the subpixel according to control of the scan gate line and the sense gate line, a reference voltage supplied to the reference line is supplied to the OLED element during at least one OLED off time after the light-emitting time and before the charging time according to control of the scan gate line and the sense gate line to turn off the OLED element, and the reference voltage is lower than a threshold voltage of the OLED element.

The subpixel can include a driving thin-film transistor (TFT) configured to drive the OLED element according to a driving voltage charged in a storage capacitor, a scan TFT configured to supply a data signal of the data line to a first electrode of the storage capacitor according to control of the scan gate line, and a sense TFT configured to supply the reference voltage of the reference line to a second electrode of the storage capacitor according to control of the sense gate line, wherein the scan TFT and the sense TFT are turned on during the charging time, wherein the scan TFT and the sense TFT are turned off during the light-emitting time, and wherein the sense TFT is turned on during the OLED off time.

During the charging time, the scan TFT and the sense TFT can be turned on by a scan pulse supplied to the scan gate line and a first sense pulse supplied to the sense gate line, respectively, and during the OLED off time, the sense TFT can be turned on by a second sense pulse supplied to the sense gate line.

At least one of any one second sense pulse separated from the first sense pulse by the light-emitting time and another second sense pulse, which is located in front of the first sense pulse and is integrated with the first sense pulse, can be supplied to the sense gate line during an active time of each frame.

The OLED off time of each horizontal line among a plurality of horizontal lines including the plural subpixels can overlap with charging times of other horizontal lines.

Second sense pulses supplied respectively to sense gate lines of a first group connected individually to horizontal lines of the first group among the plural horizontal lines can rise by being line-sequentially delayed and simultaneously fall at an end timing of the active time, and the OLED off time of each of the horizontal lines of the first group can gradually decrease.

Second sense pulses supplied respectively to sense gate lines except for a first sense gate line among the sense gate lines of the first group can simultaneously rise at a start timing of the active time and line-sequentially fall by being integrated with the first sense pulse, and the OLED off time of each of the horizontal lines of the first group including the charging time can gradually increase.

Second sense pulses supplied respectively to sense gate lines of a second group connected individually to horizontal lines of the second group among the plural horizontal lines can rise by being line-sequentially delayed and fall by being integrated with the first sense pulse and line-sequentially delayed, and the OLED off times of the horizontal lines of the second group can be integrated with corresponding charging times and can be equal.

During a blank time of each frame, OLED elements of horizontal lines except for any one horizontal line, which is selected by the scan gate driver and the sense gate driver and performs a sensing operation, can maintain a light-emitting state since the scan TFT and the sense TFT are turned off.

OLED elements of subpixels which are turned off during the active time immediately before the blank time can emit light during the blank time according to the driving voltage held in the storage capacitor during off times of the OLED elements.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Reference will now be made in detail to the exemplary embodiments of the present disclosure, examples of which are illustrated in the accompanying drawings. Wherever possible, the same reference numbers will be used throughout the drawings to refer to the same or like parts.

Figure 1:
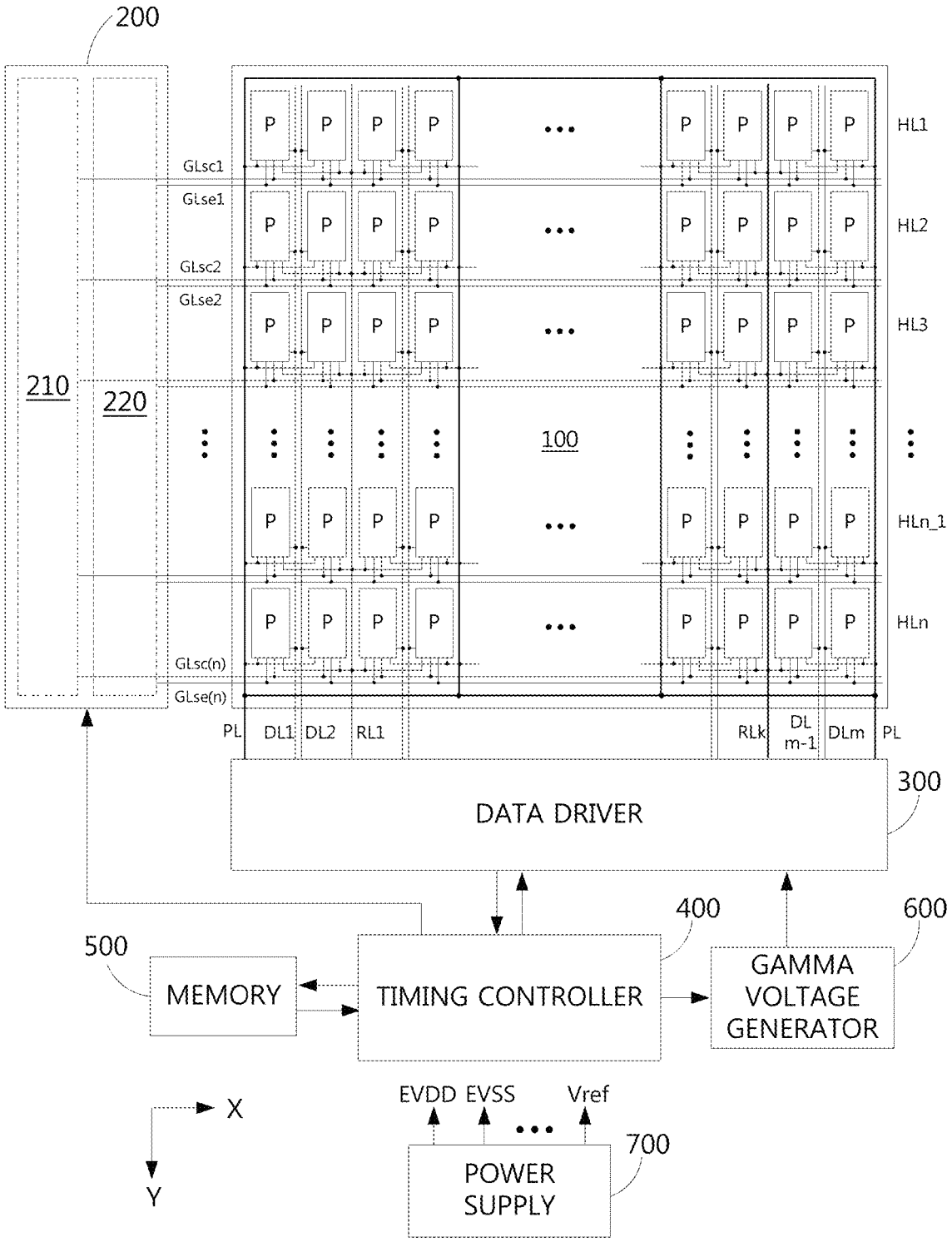
FIG. 1 is a block diagram schematically illustrating the construction of an OLED display device according to an embodiment of the present disclosure.

FIG. 1 is a block diagram schematically illustrating the construction of an OLED display device according to an embodiment of the present disclosure. All the components of the OLED display devices according to all embodiments of the present disclosure are operatively coupled and configured.

Referring to FIG. 1, the OLED display device includes a panel 100, a gate driver 200 and a data driver 300 which are panel drivers, a timing controller 400, a memory (storage) 500, a gamma voltage generator 600, and a power supply 700.

The power supply 700 generates and outputs driving voltages needed to drive the display device using an input voltage. For example, the power supply 700 generates a driving voltage of a digital circuit supplied to the data driver 300 and the timing controller 400, a driving voltage of an analog circuit supplied to the data driver 300 and the gamma voltage generator 600, and a gate-on voltage (e.g., gate-high voltage) and a gate-off voltage (e.g., gate-low voltage) used for the gate driver 200. The power supply 700 further generates a plurality of driving voltages EVDD and EVSS needed to drive the panel 100 and a reference voltage Vref, and supplies the driving voltages and the reference voltage to the panel 100 through the data driver 300.

The timing controller 400 receives image data and timing control signals from a host system. The host system can be any one of a computer, a TV system, a set-top box, and a portable terminal such as a smart watch, a tablet or a cellular phone. The timing control signals can include a dot clock, a data enable signal, a vertical synchronization signal, and a horizontal synchronization signal. The timing controller 400 generates a plurality of data control signals for controlling a driving timing of the data driver 300 using the timing control signals received from the host system and timing configuration information stored therein and supplies the data control signals to the data driver 300. The timing controller 400 generates a plurality of gate control signals for controlling a driving timing of the gate driver 200 and supplies the gate control signals to the gate driver 200.

The timing controller 400 performs a variety of image processing, such as luminance correction for reduction of power consumption or picture quality correction, with respect to an image source received from the host system. The timing controller 400 compensates for image data by applying a compensation value for a characteristic deviation of each subpixel P stored in the memory 500 and supplies the compensated image data to the data driver 300.

The timing controller 400 can control the display device to operate in a sensing mode. For example, the timing controller 400 can control the display device to operate in the sensing mode at at least one specific time among a power-on time, a power-off time, and a vertical blank time of each frame. In the sensing mode, the timing controller 400 can drive the panel 100 in the sensing mode by controlling the gate driver 200 and the data driver 300, sense a pixel current indicating electrical characteristics (a threshold voltage and mobility of a driving TFT) of each subpixel P, and update the compensation value of each subpixel stored in the memory 500 using the sensing result.

The gamma voltage generator 600 generates a reference gamma voltage set including a plurality of different reference gamma voltages having different voltage levels and supplies the reference gamma voltage set to the data driver 300. The gamma voltage generator 600 can generate a plurality of reference gamma voltages corresponding to gamma voltage characteristics of the display device according to control of the timing controller 400 and supplies the reference gamma voltages to the data driver 300. The gamma voltage generator 600 can be comprised of a programmable gamma integrated circuit (IC). The gamma voltage generator 600 can receive gamma data from the timing controller 400, generate or adjust a reference gamma voltage level according to the gamma data, and output the gamma data having the adjusted voltage level to the data driver 300.

The data driver 300 converts the image data received from the timing controller 400 into an analog data signal according to a data control signal received from the timing controller 400 and supplies the data signal to each of data lines DL1 to DLm of the panel 100, where m is a positive integer. The data driver 300 receives the plural reference gamma voltages from the gamma voltage generator 600 and segments the gamma voltages into a plurality of gradation voltages corresponding respectively to gradation values of the image data. The data driver 300 converts the image data into the analog data signal using the segmented gradation voltages and supplies the data signal to each of the data lines DL1 to DLm.

The data driver 300 supplies the reference voltage Vref received from the voltage supply 700 to reference lines RL1 to RLk of the panel 100 according to control of the timing controller 400, where k is a positive integer.

In the sensing mode, the data driver 300 supplies a sensing data voltage to each of the data lines DL1 to DLm according to control of the timing controller 400 so that subpixels P selected by the gate driver 200 are driven. In addition, the data driver 300 senses the pixel current indicating electrical characteristics of each of the driven subpixels P as a voltage through the reference lines RL1 to RLk, converts the sensed current into digital sensing data, and supplies the digital sensing data to the timing controller 400.

The data driver 300 is comprised of a plurality of data ICs individually mounted onto chip-on-films (COFs) so that the data driver 300 can be bonded and connected to the panel 100.

The gate driver 200 individually drives scan gate lines GLsc1 to GLsc(n) and sense gate lines GLse1 to GLse(n) of the panel 100 using the plural gate control signals received from the timing controller 400, where n is a positive integer. The gate driver 200 supplies a gate-on voltage VGH to corresponding gate lines during a driving period of each gate line and supplies a gate-off voltage VGL to corresponding gate lines during a non-driving period of each gate line. The gate driver 200 is comprised of a plurality of gate ICs individually mounted onto COFs so that the gate driver 200 is bonded and connected to the panel 100. Meanwhile, the gate driver 200 can be directly formed on a substrate together with a TFT array of a pixel array of the panel 100 and can be formed as a gate-in-panel (GIP) type embedded in the panel 100.

The gate driver 200 includes a scan gate driver 210 for individually driving the plural scan gate lines GLsc1 to GLsc(n) according to control of the timing controller 400, and a sense gate driver 220 for individually driving the plural sense gate lines GLse1 to GLse(n) according to control of the timing controller 400. The scan gate driver 210 is comprised of a scan shift register which includes a plurality of scan stages connected respectively to the plural scan gate lines GLsc1 to GLsc(n) and performs a shift operation according to control of the timing controller 400. The sense gate driver 220 is comprised of a sense shift register which includes a plurality of sense stages connected respectively to the plural sense gate lines GLse1 to GLse(n) and performs a shift operation according to control of the timing controller 400.

The scan gate driver 210 and the sense gate driver 220 determine charging times of subpixels P in horizontal line HL units by line-sequentially driving the scan gate lines GLsc1 to GLsc(n) and the sense gate lines GLse1 to GLse(n) in every frame.

Particularly, the sense gate driver 220 determines OLED element off times of the subpixels P in horizontal line HL units by line-sequentially driving the sense gate lines GLse1 to GLse(n) in every frame without decreasing the charging times of the subpixels P.

The panel 100 displays images through a pixel array including the subpixels P arranged in a matrix form. A basic pixel can include at least three subpixels capable of expressing white by color mixture between white (W), red (R), green (G), and blue (B) subpixels. For example, the basic pixel can include R/G/B subpixels or W/R/G/B subpixels. The basic pixels can include R/G/B subpixels, W/R/G subpixels, B/W/R subpixels, or G/B/W subpixels.

The subpixels P arranged in the direction of an X-axis and a Y-axis constitute a plurality of horizontal line HL1 to HLn, where n is a positive integer. The subpixels P of each horizontal line HL arranged in the direction of the X-axis are commonly connected to the scan gate line GLsc and the sense gate line GLse. The subpixels P of each column arranged in the direction of the Y-axis are commonly connected to each data line DL. The subpixels P of each column or plural columns can be commonly connected to a reference line RL and a power line PL. For example, as illustrated in FIG. 1, the subpixels P of 4 columns can be commonly connected to the reference line RL and the subpixels of 4 columns can be commonly connected to the power line PL.

The subpixels P of the plural horizontal lines HL1 to HLn are line-sequentially driven in every frame according to control of the scan gate lines GLsc1 to GLsc(n) and the sense gate lines GLse1 to GLse(n) to charge data and OLED elements emit light according to the charged data to display images.

The subpixels P of the plural horizontal lines HL1 to HLn turn off OLED elements by applying the reference voltage Vref lower than threshold voltages Vth of the OLED elements to the OLED elements through the reference lines RL1 to RLk according to control of the sense gate lines GLse1 to GLse(n) at at least one specific time after a light-emitting time and before a charging time in each frame, thereby implementing a black frame. Therefore, an MPRT can be improved.

Particularly, an OLED off time of each horizontal line HL controlled by each sense gate line GLse can overlap with charging times of other plural horizontal lines HL and uses the reference voltage Vref so that OLED elements can be turned off regardless of a charging time and input data of the subpixel P.

Figure 2:
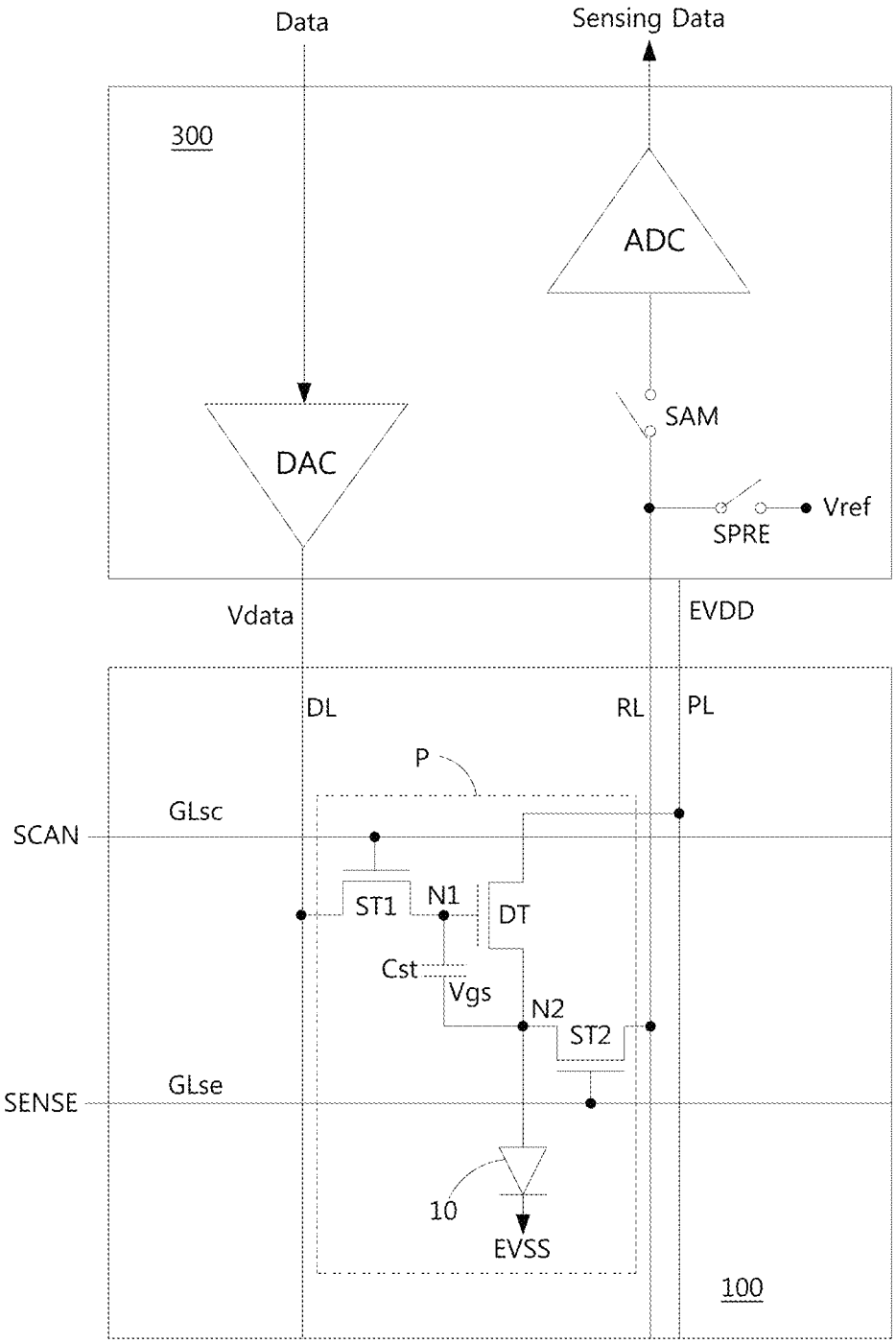
FIG. 2 is an equivalent circuit diagram illustrating a partial construction of a pixel circuit and a data driver according to an embodiment of the present disclosure.

FIG. 2 is an equivalent circuit diagram illustrating a partial construction of a pixel circuit and a data driver according to an embodiment of the present disclosure. A description of FIG. 2 will be given in association with FIG. 1.

Referring to FIG. 2, each subpixel P connected between a high-potential power (hereinafter, EVDD) line PL and a low-potential power (hereinafter, EVSS) line includes an OLED element 10 and a pixel circuit including scan and sense TFTs ST1 and ST2, a driving TFT DT, and a storage capacitor Cst to independently drive the OLED element 10.

The scan TFT ST1, the sense TFT ST2, and the driving TFT DT can use amorphous silicon (a-Si) TFTs, polycrystalline silicon (poly-Si) TFTs, oxide TFTs, or organic TFTs.

The OLED element 10 includes an anode connected to a source node N2 of the driving TFT DT, a cathode connected to the EVSS line, and an organic light-emitting layer connected between the anode and the cathode. Although the anode is independently formed with respect to each subpixel, the cathode can be a common electrode shared by all subpixels. If a driving current is supplied to the OLED element 10 by the driving TFT DT, electrons and holes are respectively injected from the cathode and the anode into the organic light-emitting layer and recombine in the organic light-emitting layer so that the OLED element 10 emits light having brightness which is proportional to a current value of the driving current by applying fluorescent or phosphorescent materials.

The scan TFT ST1 is turned on according to a scan gate signal SCAN supplied to a scan gate line GLsc by the scan gate driver 210 and supplies a data voltage Vdata supplied to a data line by the data driver 300 to a gate node N1 of the driving TFT DT.

The sense TFT ST2 is turned on according to a sense gate signal SENSE supplied to a sense gate line GLse by the sense gate driver 220 and supplies a reference voltage Vref supplied to a reference line RL by the data driver 300 to the source node N2 of the driving TFT DT. The reference voltage Vref is less than a threshold voltage Vth of the OLED element 10. Upon sensing the characteristics of the subpixel P, the sense TFT ST2 further outputs current received from the driving TFT DT to the reference line RL of a floating state.

The storage capacitor Cst connected between the gate node N1 and the source node N2 of the driving TFT DT charges a difference voltage between the data voltage Vdata and the reference voltage Vref supplied respectively to the gate node N1 and the source node N2 of the driving TFT DT through the scan and sense TFTs ST1 and ST2 which are turned on as a driving voltage Vgs, holds the driving voltage Vgs charged during a light-emitting time during which the scan and sense TFTs ST1 and ST2 are turned off, and provides the driving voltage Vgs to the driving TFT DT.

The driving TFT DT controls current received from the EVDD line PL according to the driving voltage Vgs of the storage capacitor Cst and supplies current to the OLED element 10, so that the OLED element 10 emits light.

In a sensing mode, the data driver 300 converts sensing data received from the timing controller 400 into the sensing data voltage Vdata through a digital-to-analog converter (DAC) and supplies the data voltage Vdata to the data line DL. The data driver 300 supplies the reference voltage Vref to the reference line RL through a precharge switch SPRE. Thereafter, the precharge switch SPRE is turned off. The driving TFT DT is driven by the difference voltage between the sensing data voltage Vdata supplied through the scan TFT ST1 and the reference voltage Vref supplied through the sense TFT ST2. Current considering characteristics of the driving TFT DT (e.g., a threshold voltage Vth and mobility of the driving TFT DT) is charged as a voltage in a line capacitor of the reference line RL which is a floating state through the sense TFT ST2. An analog-to-digital converter (ADC) receives the voltage charged in the reference line RL through a sampling switch SAM, converts the charged voltage into sensing data of each subpixel P, and outputs the sensing data to the timing controller 400. This sensing mode can operate at at least one of among a power-on time, a vertical blank time, or a power-off time.

In a display mode, the data driver 300 converts image data received from the timing controller 400 into the data voltage Vdata through the DAC, supplies the data voltage Vdata to the data line, and supplies the reference voltage Vref to the reference line RL through the precharge switch SPRE. During a charging time during which the scan TFT ST1 and the sense TFT ST2 are turned on, the driving voltage Vgs which is a difference between the data voltage Vdata and the reference voltage Vref is charged in the storage capacitor Cst. During a light-emitting time during which the scan TFT ST1 and the sense TFT ST2 are turned off, the driving TFT DT drives the OLED element 10 according to the driving voltage held in the storage capacitor Cst so that the OLED element emits light. At at least one specific time after the light-emitting time of the subpixel P and before the charging time of the subpixel P, only the sense TFT ST2 is turned on and the reference voltage Vref lower than the threshold voltage Vth of the OLED element 10 is supplied to the OLED element 10, so that the OLED element 10 is turned off.

In this way, since the OLED element 10 is turned off using the sense TFT ST2 and the reference line RL regardless of input data and a charging time, the MPRT can be improved by implementing a black frame and picture quality can be improved by sufficiently securing the charging time of the subpixel P.

Figure 3:
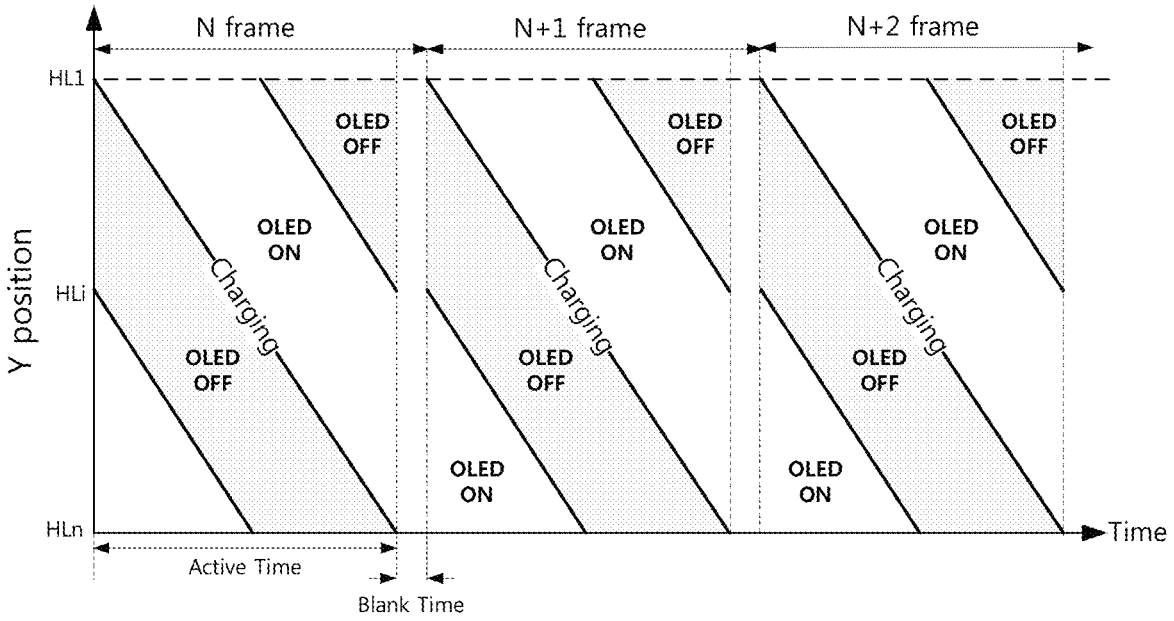
FIG. 3 is a diagram illustrating a driving method of each frame according to an embodiment of the present disclosure.

FIG. 3 is a diagram illustrating a driving method of each frame according to an embodiment of the present disclosure.

Referring to FIG. 3, while n horizontal lines HL1 to HLn are line-sequentially scanned during an active time of each frame, each subpixel charges a driving voltage corresponding to data and an OLED element is turned on and emits light during a subsequent light-emitting time.

During the active time of each frame, while i-th to n-th horizontal lines HLi to HLn are sequentially charged, the OLED elements of the first to i-th horizontal lines HL1 to HLi receive a reference voltage and are turned off through a sense TFT which is turned on at a specific time after a light-emitting time and before a vertical blank time. In this case, since OLED off times of the first to i-th horizontal lines HL1 to HLi are started by being line-sequentially delayed and are simultaneously ended at an end timing of the active time, the OLED off times gradually decrease. Here, i can be a positive integer.

During the active time of each frame, the OLED elements of the second to n-th horizontal lines HL2 to HLn except for the first horizontal line HL1 receive the reference voltage and are turned off through a sense TFT which is turned on at a specific time before a line-sequentially given charging time. In this case, since OLED off times of the second to i-th horizontal lines HL1 to HLi are simultaneously started at a start timing of the active time and are ended at start timings of line-sequentially delayed charging times, the OLED off times gradually increase.

During the active time of each frame, since OLED off times of the i-th to n-th horizontal lines HLi to HLn are started by being line-sequentially delayed and are ended at start timings of line-sequentially delayed charging times, the OLED off times are equal.

All subpixels have an equal charging time and an equal light-emitting time. OLED off durations of all Subpixels are also identical.

During the vertical blank time of each frame, since any one horizontal line selected by the gate driver is sensed and both the scan TFT and the sense TFT are turned off, OLED elements of the other horizontal lines maintain a light-emitting state according to a driving voltage held in the storage capacitor. Meanwhile, during an active time before the vertical blank time, in a non-sensing line, OLED elements of subpixels which are turned off by the reference voltage Vref received through the sense TFT emit light according to the driving voltage held in the storage capacitor during an OLED off time since both the scan TFT and the sense TFT are turned off during the vertical blank time.

Figure 4:
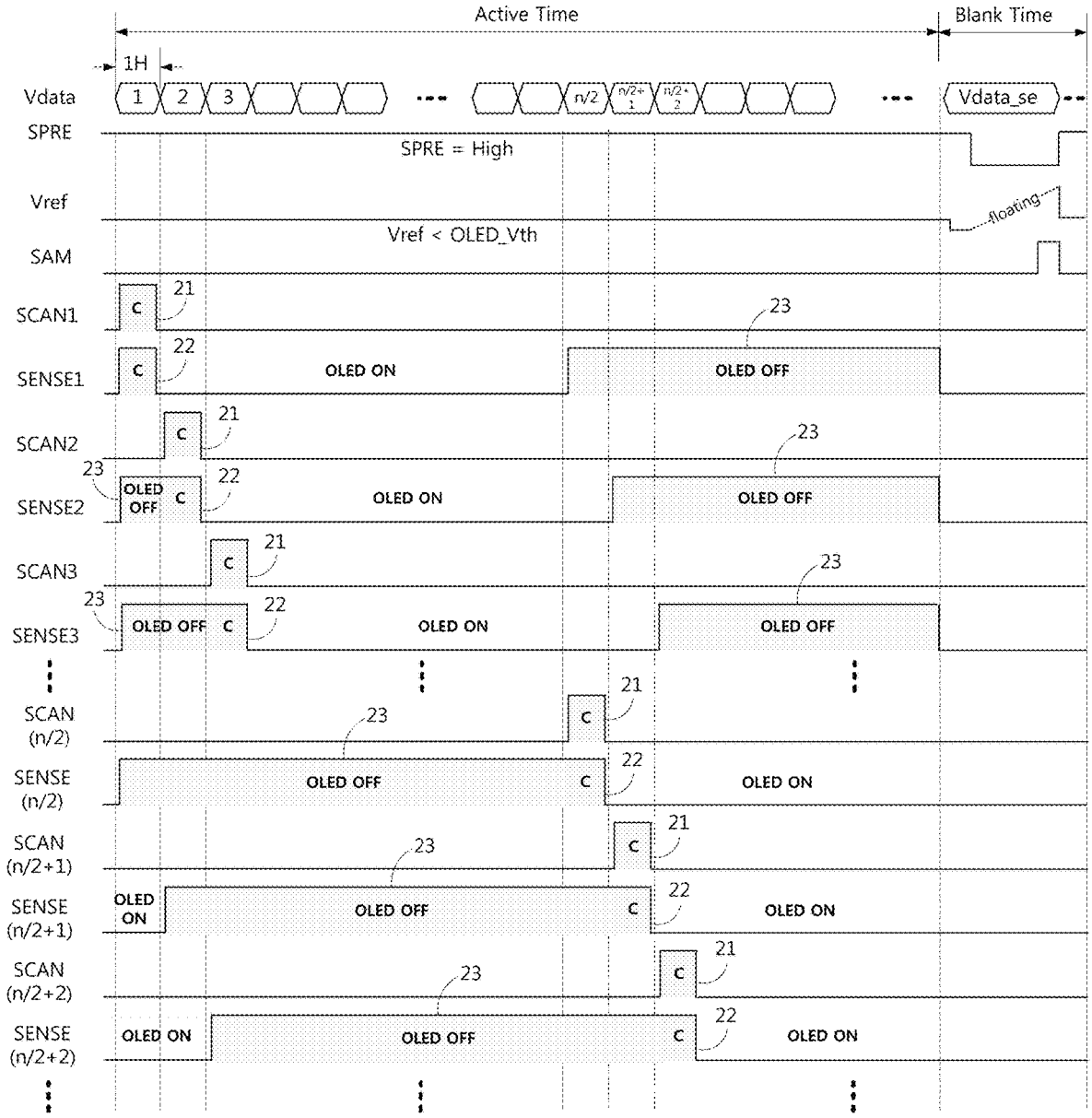
FIG. 4 is a driving waveform chart of scan gate lines and sense gate lines according to an embodiment of the present disclosure.

FIG. 4 is a driving waveform chart of scan gate lines and sense gate lines according to an embodiment of the present disclosure. A description of FIG. 4 will be given in association with FIGS. 1 and 2.

Referring to FIG. 4, during an active time of one frame, the data driver 300 supplies the data signal Vdata to the data lines DL1 to DLm in units of one horizontal (1H) period and supplies the reference voltage Vref lower than a threshold voltage Vth of an OLED element to the reference lines RL1 to RLk through the precharge switch SPRE.

The scan gate driver 210 line-sequentially supplies a scan pulse 21 as scan gate signals SCAN1 to SCANn supplied respectively to the scan gate lines GLsc1 to GLsc (n), thereby sequentially driving the scan gate lines GLsc1 to GLsc(n). The sense gate driver 220 line-sequentially supplies a first sense pulse 22 synchronized with the scan pulse 21 as sense gate signals SENSE1 to SENSEn supplied respectively to the sense gate lines GLse1 to GLse(n), thereby sequentially driving the sense gate lines GLse1 to GLse(n). Thus, subpixels of each horizontal line HL charge a driving voltage during a charging time C during which the scan TFT and the sense TFT are turned on and OLED elements emit light according to the charging voltage during a light-emitting time during which the scan TFT and the sense TFT are turned off.

The sense gate driver 220 supplies a second sense pulse 23 as the sense gate signal SENSE at any one specific timing after the light-emitting time of each horizontal line HL and before the charging time C. Thus, the OLED elements of a horizontal line HL to which the second sense pulse 23 is supplied are turned off by receiving the reference voltage Vref lower than a threshold voltage Vth through the sense TFT, which is turned on. An OLED off time can be controlled by adjusting a pulse width of the second sense pulse 23.

Referring to FIG. 4, for example, during an active time of each frame, the first to n-th scan gate signals SCAN1 to SCAN(n) and the first to n-th sense gate signals SENSE1 to SENSE(n) line-sequentially supply the scan pulse 21 and the first sense pulse 22 so that subpixels of the first to n-th horizontal lines HL1 to HLn are sequentially charged and OLED elements emit light according to a charging voltage during a subsequent light-emitting time.

During a charging time C during which the scan pulse 21 and the first sense pulse 22 are line-sequentially supplied to the (n/2)-th to n-th scan gate signals SCAN (n/2) to SCAN (n) and the (n/2)-th to n-th sense gate signals SENSE(n/2) to SENSE(n), the first to (n/2-1)-th sense gate signals SENSE1 to SENSE(n/2-1) line-sequentially supply the second sense pulse 23 and OLED elements of corresponding horizontal lines HL1 to HL(n/2-1) are turned off by receiving the reference voltage Vref through the sense TFT which is turned on at a specific time after a light-emitting time. The second sense pulses 23 of the first to (n/2-1)-th sense gate signals SENSE1 to SENSE(n/2-1) rise by being line-sequentially delayed and simultaneously fall at an end timing of the active time. Therefore, OLED off times of corresponding horizontal lines HL1 to HL(n/2-1) gradually decrease.

At a specific time before the charging time C during which the scan pulse 21 and the first sense pulse 22 are line-sequentially supplied to the second to the n-th scan gate signals SCAN2 to SCAN(n) and the second to the n-th sense gate signals SENSE2 to SENSE(n), the second to the n-th sense gate signals SENSE2 to SENSE(n) supply the second sense pulse 23 so that OLED elements of corresponding horizontal lines HL1 to HL(n/2-1) are turned off by receiving the reference voltage Vref through the sense TFT which is turned on at the specific time before the charging time C. The second sense pulse 23 of the second to n-th sense gate signals SENSE2 to SENSE(n) is supplied by being integrated with the first sense pulse 22 following the second sense pulse 23. Even during the charging time C during which the scan pulse 21 and first sense pulse 22 are supplied, since the OLED element is turned off, the OLED element is turned off during an integrated time of the second sense pulse 23 and the first sense pulse 22.

Since the second sense pulses 23 of the second to (n/2)-th sense gate signals SENSE2 to SENSE(n/2) simultaneously rise at a start timing of an active time and line-sequentially fall by being integrated with the first sense pulses 22 which are line-sequentially delayed, OLED off times of corresponding horizontal lines HL2 to HL(n/2) including the first horizontal line HL1 gradually increase.

Since the second sense pulses 23 of the (n/2+1)-th to n-th sense gate signals SENSE(n/2+1) to SENSE(n) rise by being line-sequentially delayed during the active time and line-sequentially fall integratedly with the first sense pulses 22 which are line-sequentially delayed, OLED off times of the corresponding horizontal lines HL(n/2+1) to HL(n) are equal.

During a vertical blank time, a sensing operation for subpixels of any one horizontal line selected by the scan gate driver 210 and the sense gate driver 220 is performed. The precharge switch SPRE is turned on until the charging time of the sensing data voltage Vdata se and the reference voltage Vref and then is turned off and the reference line RL is floated. The reference voltage Vref supplied during the charging time of the vertical blank time can be equal or lower than the reference voltage Vref supplied during the active time. Since the driving TFT DT of subpixels to which the sensing data voltage Vdata se and the reference voltage Vref are supplied is driven and current considering characteristics of the driving TFT DT is charged in a line capacitor of a reference line RL of a floating state through the sense TFT ST2 as a voltage, the voltage of the reference line RL gradually rises. The sampling switch SAM is turned on at a desired sensing time and the voltage charged in the reference line RL is supplied to the ADC. The ADC converts the charged voltage into sensing data and outputs the sensing data to the timing controller 400. A recovery data voltage Vdata and a reference voltage Vref are further supplied to the sensed subpixels and then are held so that the sensed subpixels are recovered to a holding state of the driving voltage similarly to other subpixels which are not sensed.

Figure 5:
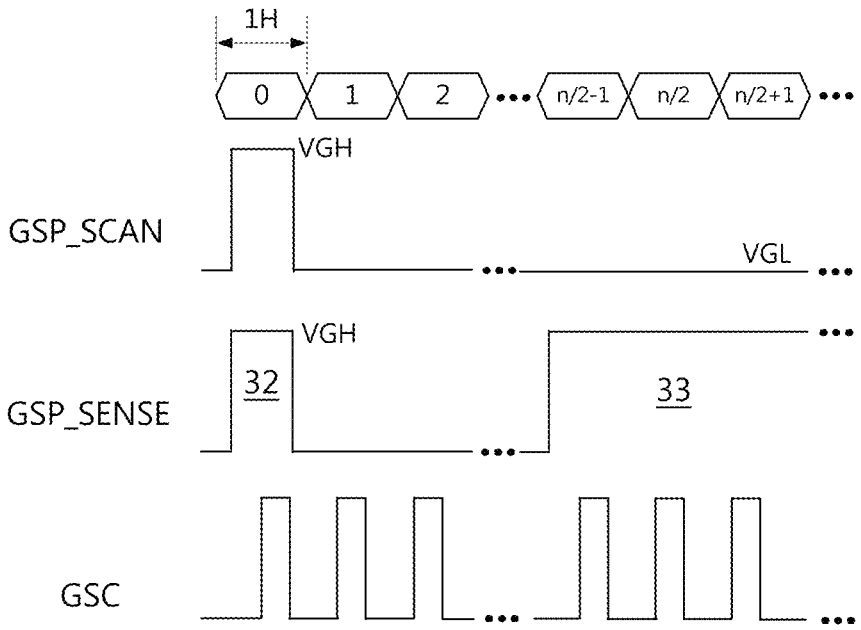
FIG. 5 is a waveform chart of input signals of a gate driver according to an embodiment of the present disclosure.

FIG. 5 is a waveform chart of input signals of a gate driver according to an embodiment of the present disclosure.

Referring to FIG. 5, the scan gate driver 210 illustrated in FIG. 1 sequentially shifts a first gate start pulse GSP_SCAN according to a gate shift clock GSC during every horizontal period so that scan pulses 21 of the scan gate signals SCAN1 to SCAN(n) illustrated in FIG. 4 are supplied to the scan gate lines GLsc1 to GLsc(n), respectively. The first gate start pulse GSP_SCAN can be supplied with the same pulse width as the scan pulse 21 during a duration before the first horizontal period.

The sense gate driver 220 sequentially shifts a second gate start pulse GSP_SENSE according to the gate shift clock GSC during every horizontal period to supply the first sense pulses 22 and the second sense pulses 23 of the sense gate signals SENSE1 to SENSE(n) illustrated in FIG. 4 to the sense gate lines GLse1 to GLse(n). A first pulse 32 of the second gate start pulse GSP_SENSE is supplied with the same pulse width as the first sense pulse 22 and is supplied in synchronization with the first gate start pulse GSP_SCAN. A second pulse 33 of the second gate start pulse GSP_SENSE can be supplied with the same pulse width as the second sense pulse 23. The pulse width of the second pulse 23 can be adjusted. The pulse width of the second sense pulse 23 can be determined by the pulse width of the second pulse 33 so that an off time of an OLED element can be controlled.

In this way, an OLED display device and a method of driving the same according to an embodiment implement a black frame using a sense TFT and a reference line regardless of a charging time and input data by turning off an OLED element so that an MPRT can be improved and picture quality can be improved by sufficiently securing the charging time of a subpixel.

In addition, an OLED display device and a method of driving the same according to an embodiment do not need to supply black data so that an additional memory for storing input image data is not needed and thus manufacturing costs can be reduced as compared with a conventional display device.

As described above, in an OLED display device according to an embodiment of the present disclosure, each subpixel charges a driving voltage corresponding to data during an active time of each frame and turns off an OLED element using a sense TFT and a reference line at at least one specific time after a light-emitting time during which the OLED element emits light through a driving TFT before a charging time. Accordingly, an MPRT can be improved by implementing a black frame regardless of a charging time and input data and picture quality can be improved by sufficiently securing a charging time of each subpixel.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. An organic light-emitting diode (OLED) display device, comprising:

a panel including a plurality of subpixels, each of the plurality of subpixels being connected to a corresponding scan gate line of scan gate lines, a corresponding sense gate line of sense gate lines, a corresponding data line of data lines, a corresponding reference line of reference lines, and a corresponding power line power lines;

a scan gate driver configured to drive the scan gate lines;

a sense gate driver configured to drive the sense gate lines; and a data driver configured to drive the data lines and the reference lines, wherein for a subpixel among the plurality of subpixels, the subpixel performs a charging operation during a charging time of the subpixel during a current frame according to control of the corresponding scan gate line and the corresponding sense gate line, an OLED element of the subpixel emits light during a light-emitting time of the subpixel during the current frame according to control of the corresponding scan gate line and the corresponding sense gate line, a reference voltage supplied to the corresponding reference line is supplied to the OLED element during an OLED off time during the current frame after the light-emitting time during the current frame and before a charging time of a next frame subsequent to the current frame according to control of the corresponding scan gate line and the corresponding sense gate line to turn off the OLED element, and the reference voltage is lower than a threshold voltage of the OLED element, wherein the subpixel further comprises:

a driving thin-film transistor (TFT) configured to drive the OLED element according to a driving voltage charged in a storage capacitor;

a scan TFT configured to supply a data signal of the corresponding data line to a first electrode of the storage capacitor according to control of the corresponding scan gate line; and a sense TFT configured to supply the reference voltage of the corresponding reference line to a second electrode of the storage capacitor according to control of the corresponding sense gate line, wherein the sense TFT is turned on during the OLED off time while the scan TFT is turned off during the OLED off time, wherein the scan TFT and the sense TFT are turned on during the charging time, and wherein the scan TFT and the sense TFT are turned off during the light-emitting time.

2. The OLED display device of claim 1, wherein, during the charging time, the scan TFT and the sense TFT are turned on by a scan pulse supplied to the corresponding scan gate line and a first sense pulse supplied to the corresponding sense gate line, and wherein, during the OLED off time, the sense TFT is turned on by a second sense pulse supplied to the corresponding sense gate line.

3. The OLED display device of claim 2, wherein at least one of any one second sense pulse separated from the first sense pulse by the light-emitting time and another second sense pulse, which is located in front of the first sense pulse and is integrated with the first sense pulse, is supplied to the corresponding sense gate line during an active time of each frame.

4. The OLED display device of claim 3, wherein the OLED off time of each horizontal line among a plurality of horizontal lines including the plurality of subpixels overlaps with charging times of other horizontal lines.

5. The OLED display device of claim 4, wherein second sense pulses supplied respectively to sense gate lines of a first group connected individually to horizontal lines of the first group among the plurality of horizontal lines rise by being line-sequentially delayed and simultaneously fall at an end timing of the active time, and the OLED off time of each of the horizontal lines of the first group gradually decreases.

6. The OLED display device of claim 5, wherein second sense pulses supplied respectively to sense gate lines except for a first sense gate line among the sense gate lines of the first group simultaneously rise at a start timing of the active time and line-sequentially fall by being integrated with the first sense pulse, and the OLED off time of each of the horizontal lines of the first group including the charging time gradually increases.

7. The OLED display device of claim 6, wherein second sense pulses supplied respectively to the sense gate lines of a second group connected individually to horizontal lines of the second group among the plurality of horizontal lines rise by being line-sequentially delayed and fall by being integrated with the first sense pulse and line-sequentially delayed, and the OLED off times of the horizontal lines of the second group are integrated with corresponding charging times and are equal.

8. The OLED display device of claim 7, wherein, during a blank time of each frame, OLED elements of horizontal lines except for any one horizontal line, which is selected by the scan gate driver and the sense gate driver and performs a sensing operation, maintain a light-emitting state since the scan TFT and the sense TFT are turned off.

9. The OLED display device of claim 8, wherein OLED elements of subpixels which are turned off during the active time immediately before the blank time emit light during the blank time according to the driving voltage held in the storage capacitor during off times of the OLED elements.

10. An organic light-emitting diode (OLED) display device, comprising:

a panel including a plurality of subpixels, each of the plurality of subpixels being connected to a corresponding scan gate line of scan gate lines, a corresponding sense gate line of sense gate lines, a corresponding data line of data lines, a corresponding reference line of reference lines, and a corresponding power line power lines;

a scan gate driver configured to drive the scan gate lines;

a sense gate driver configured to drive the sense gate lines; and a data driver configured to drive the data lines and the reference lines, wherein for a subpixel among the plurality of subpixels, the subpixel performs a charging operation during a charging time of the subpixel during a current frame according to control of the corresponding scan gate line and the corresponding sense gate line, an OLED element of the subpixel emits light during a light-emitting time of the subpixel during the current frame according to control of the corresponding scan gate line and the corresponding sense gate line, a reference voltage supplied to the corresponding reference line is supplied to the OLED element during an OLED off time during the current frame after the light-emitting time during the current frame and before a charging time of a next frame subsequent to the current frame according to control of the corresponding scan gate line and the corresponding sense gate line to turn off the OLED element, and the reference voltage is lower than a threshold voltage of the OLED element, wherein the subpixel comprises:

a driving thin-film transistor (TFT) configured to drive the OLED element according to a driving voltage charged in a storage capacitor;

a scan TFT configured to supply a data signal of the corresponding data line to a first electrode of the storage capacitor according to control of the corresponding scan gate line; and a sense TFT configured to supply the reference voltage of the corresponding reference line to a second electrode of the storage capacitor according to control of the corresponding sense gate line, wherein the scan TFT and the sense TFT are turned on during the charging time, wherein the scan TFT and the sense TFT are turned off during the light-emitting time, wherein the sense TFT is turned on during the OLED off time, wherein, during the charging time, the scan TFT and the sense TFT are turned on by a scan pulse supplied to the corresponding scan gate line and a first sense pulse supplied to the corresponding sense gate line, and wherein, during the OLED off time, the sense TFT is turned on by a second sense pulse supplied to the corresponding sense gate line.

11. The OLED display device of claim 10, wherein at least one of any one second sense pulse separated from the first sense pulse by the light-emitting time and another second sense pulse, which is located in front of the first sense pulse and is integrated with the first sense pulse, is supplied to the corresponding sense gate line during an active time of each frame.

12. The OLED display device of claim 11, wherein the OLED off time of each horizontal line among a plurality of horizontal lines including the plurality of subpixels overlaps with charging times of other horizontal lines.

13. The OLED display device of claim 12, wherein second sense pulses supplied respectively to sense gate lines of a first group connected individually to horizontal lines of the first group among the plurality of horizontal lines rise by being line-sequentially delayed and simultaneously fall at an end timing of the active time, and the OLED off time of each of the horizontal lines of the first group gradually decreases.

14. The OLED display device of claim 13, wherein second sense pulses supplied respectively to sense gate lines except for a first sense gate line among the sense gate lines of the first group simultaneously rise at a start timing of the active time and line-sequentially fall by being integrated with the first sense pulse, and the OLED off time of each of the horizontal lines of the first group including the charging time gradually increases.

15. A pixel structure for an organic light-emitting diode (OLED) display device, the pixel structure comprising:

a subpixel including an OLED element, the subpixel being connected to a scan gate line, a sense gate line, a data line, a reference line, and a power line power line, wherein the subpixel is configured to:

perform a charging operation during a charging time of the subpixel during a current frame according to control of the scan gate line and the sense gate line, and emit light via an OLED element of the subpixel during a light-emitting time of the subpixel during the current frame according to control of the scan gate line and the sense gate line, wherein a reference voltage supplied to the reference line is supplied to the OLED element during an OLED off time during the current frame after the light-emitting time during the current frame and before the charging time of a next frame subsequent to the current frame according to control of the scan gate line and the sense gate line to turn off the OLED element, wherein the reference voltage is lower than a threshold voltage of the OLED element, wherein the OLED off time occurs between the OLED on time and a sensing mode of a blank time period during the current frame, and wherein the OLED off time of each horizontal line among a plurality of horizontal lines including the plurality of subpixels overlaps with charging times of other horizontal lines.

16. The pixel structure of claim 15, wherein the subpixel comprises:

a driving thin-film transistor (TFT) configured to drive the OLED element according to a driving voltage charged in a storage capacitor;

a scan TFT configured to supply a data signal of the data line to a first electrode of the storage capacitor according to control of the scan gate line; and a sense TFT configured to supply the reference voltage of the reference line to a second electrode of the storage capacitor according to control of the sense gate line, wherein the scan TFT and the sense TFT are turned on during the charging time, wherein the scan TFT and the sense TFT are turned off during the light-emitting time, and wherein the sense TFT is turned on during the OLED off time.

17. The pixel structure of claim 16, wherein, during the charging time, the scan TFT and the sense TFT are turned on by a scan pulse supplied to the scan gate line and a first sense pulse supplied to the sense gate line, and wherein, during the OLED off time, the sense TFT is turned on by a second sense pulse supplied to the sense gate line.

18. The pixel structure of claim 17, wherein at least one of any one second sense pulse separated from the first sense pulse by the light-emitting time and another second sense pulse, which is located in front of the first sense pulse and is integrated with the first sense pulse, is supplied to the sense gate line during an active time of each frame.

* * * * *